US008702141B2

(12) United States Patent
Vinciguerra

(10) Patent No.: US 8,702,141 B2
(45) Date of Patent: Apr. 22, 2014

(54) SERVING TRAY FOR USE WITH LEFT OR RIGHT HAND

(76) Inventor: John Vinciguerra, Bronx, NY (US)

( * ) Notice: Subject to any disclaimer, the term of this patent is extended or adjusted under 35 U.S.C. 154(b) by 0 days.

(21) Appl. No.: 13/601,190

(22) Filed: Aug. 31, 2012

(65) Prior Publication Data

US 2013/0057006 A1 Mar. 7, 2013

Related U.S. Application Data

(60) Provisional application No. 61/529,956, filed on Sep. 1, 2011.

(51) Int. Cl.
*A47G 23/06* (2006.01)

(52) U.S. Cl.
USPC ..... 294/172; 294/25

(58) Field of Classification Search
USPC ..... 294/172, 144, 146, 219, 25; 206/557; 16/430
See application file for complete search history.

(56) References Cited

U.S. PATENT DOCUMENTS

| | | | | |
|---|---|---|---|---|
| 995,114 | A * | 6/1911 | Clark et al. | 294/144 |
| 3,162,344 | A * | 12/1964 | Sabol | 294/143 |
| 4,461,396 | A * | 7/1984 | Harper | 220/23.83 |
| 5,797,495 | A * | 8/1998 | Lerrick | 206/557 |
| 7,717,483 | B1 | 5/2010 | Bombara | |
| D633,504 | S | 3/2011 | Alexander, Jr. | |
| 8,113,380 | B2 * | 2/2012 | Goren | 220/755 |
| 2007/0215512 | A1 | 9/2007 | Bellissimo | |
| 2009/0167041 | A1 * | 7/2009 | James et al. | 294/141 |
| 2010/0230322 | A1 * | 9/2010 | Nicholson et al. | 206/560 |
| 2013/0015096 | A1 * | 1/2013 | BeVier et al. | 206/557 |
| 2013/0098800 | A1 * | 4/2013 | Rehmanji et al. | 206/557 |

* cited by examiner

*Primary Examiner* — Saul Rodriguez
*Assistant Examiner* — Gabriela Puig
(74) *Attorney, Agent, or Firm* — Daniel Boudwin; Global Intellectual Property Agency LLC

(57) ABSTRACT

An object-carrying tray is provided that can be used by both left and right-handed users. The tray has a flat upper surface and a lower surface having a molded depression of two hands. The hands are positioned so that the palms, and several inner fingers overlap and the thumbs point in opposing directions. This configuration permits both a left or right-handed user to place his or her hand within the depressions. The user places his or her hand within the appropriate depressions to reduce the likelihood that the tray will slide around on a user's hand while the device is in use.

10 Claims, 3 Drawing Sheets

SERVING TRAY FOR USE WITH LEFT OR RIGHT HAND

CROSS REFERENCE TO RELATED APPLICATION

This application claims the benefit of U.S. Provisional Application No. 61/529,956 filed on Sep. 1, 2012 entitled "JV115296." The patent application identified above is incorporated here by reference in its entirety to provide continuity of disclosure.

BACKGROUND OF THE INVENTION

1. Field of the Invention

The present invention relates to a device for facilitating the easy carrying of objects. More specifically, it relates to a tray that having a molded human hand imprint that can be used by servers and wait staff to help them balance service items on one hand. People who work at busy restaurants and must constantly carry trays full of food and drinks will appreciate the device.

Carrying multiple delicate or volatile objects at the same time has always presented a problem for people. Humans have only two hands and thus are limited with respect to the number of objects that they can safely carry at one time. Food and Drink items are particularly problematic because the contents can slosh and spill while in transit. Waiters, party hosts, and bar servers have long lamented the hazards of carrying several glasses of drinks at the same time. Even with the drinks placed neatly on a flat surfaced service tray, there is no guarantee that the drinks will arrive at their destination. The hands of servers as well as the serving trays themselves can become wet and slippery, increasing the chance that the tray will be dropped or will slide off the server's hand. To reduce the risk of dropping a tray, a server may wish to transfer it from a wet hand to their other hand. But this can be problematic with trays that are adapted for single hand use. A serving tray is needed that can be used with either a right or left handed user and reduces the risk that a tray will slide off a server's hand while the tray is in transit.

2. Description of the Prior Art

The present invention is a tray that provides a user with a better grip on a tray or other flat-bottomed object, and then he or she would have with just their bare hand. The device is made of a tacky material and has an imprinted area for placement of a user's hand. These features reduce the extent of slippage that a user's hand experiences while the device is in use. Prior art devices disclose gloves, pockets, and molds for use in maintain grip on an object, but these devices do not disclose a tray contains a molded imprint having 6 or more finger regions to permit use of the object with either of a user's hands.

A serving tray with a hand shaped cavity on the tray underside is disclosed by Bellissimo, U.S. Patent Application Publication No. 2007/0215512. The tray is circular with an upper and lower rim. The upper rim prevents drinks or food items from falling off the edge of the tray. Below the tray there is a cavity in the shape of a human hand and arm. The cavity extends from the center of the tray to the edge of the tray, where a portion of the lower rim is cut-away to permit the user's arm to rest in the cavity. To further secure the tray to a user's hand, a strap extends across the finger area of the cavity. To use the device, the user simply slides his or her arm into the cavity, slipping the fingers under the strap and into the finger regions. The tray is then turned over so that the upper rim is directed towards the ceiling. Drinks, food and other service items may be placed on the tray and carried. This structure of this device presents a problem in that the hand shaped cavity can only be utilized by a left or right hand but not both. The present invention provides a number of finger shaped depressions, including a thumb depression on either side of the hand mold. This structure permits a user to switch hands easily, and adjust the tray from one side of the body to the other. Bellissimo does not teach a device capable of being used with either of a user's hands.

Bombara, U.S. Pat. No. 7,717,483 discloses a serving tray similar to that of Bellissimo but does not include the hand mold region. The Bombara tray is circular with an upper rim to prevent food and drinks from falling off the upper surface. Two apertures extend through the tray to permit a securing strap to pass over the upper surface and down through the apertures. A hand is placed, with the palm against the lower surface of the serving tray, and the securing strap is removably secured around the outside of the hand. This helps keep the hand in place while the tray is in use. Unlike the present invention, the Bombardo tray does not feature a hand-shape depression. Bombara requires that a user's hand be strapped in place to reduce slipping while the tray is in use. Switching from one hand to the other requires unsecuring the strap from the first hand and resecuring it to a second. Though this does permit the use of either hand when carrying the tray, it does not offer the ease of hand transfer that the present invention provides.

Another object balancing invention is taught by Alexander, Jr. U.S. Design Pat. No. D633504 shows a glove secured to the back of a tablet computer holder. The device features a sleeve adapted to hold a tablet computer and a mitt secured to the back of the sleeve. The user places the tablet computer in the sleeve and then places his or her hand in the mitt. In this way, the user can hold the tablet computer without having to assert regular pressure on the bottom/back of the device. Like the device of Bombardo, the securement means of Alexander, Jr. makes transfer of the device from one hand to another cumbersome. The present invention does not require straps to reduce slipping of the tray.

The prior art does not teach a serving tray that provides a plurality of finger shaped depressions to allow a user to user either of his hands to hold the tray. The present invention provides such a tray that can be used with either of a user's hands. It substantially diverges in design elements from the prior art and consequently it is clear that there is a need in the art for an improvement to existing object carrying devices. In this regard the instant invention substantially fulfills these needs.

SUMMARY OF THE INVENTION

In view of the foregoing disadvantages inherent in the known types of object carrying devices now present in the prior art, the present invention provides a new cutout region that is shaped to permit either of a user's hands to fit within the cutout wherein the same can be utilized for providing convenience for the user when carrying objects on the tray.

The present invention has a main body that is a platform with an upper and lower surface. The upper surface of the platform is flat and smooth to provide a stable support for objects in transit. On the underside of the platform, a large depression or cutout is disposed. This depression in the lower surface has at least six finger-shaped depressions four in the middle and a thumb shaped impression on either side of the central fingers. The plurality of finger depressions provides a space for either a right or left hand to be placed. A user may place a hand within the depressions, lining his thumb up with a thumb depression, and then turn the tray over so that it is balanced on the user's hand. Drinks, food items, candles, any other portable objects may be placed on the upper surface of the tray platform. The molded depressions will reduce the likelihood that the user's hand will slip, thereby making it easier for him to carry the tray.

It may have a generally geometric shape such as a circle, square, rectangle, or the like. A variety of materials may be used in the constriction of the tray according to the particular embodiment in manufacture. Thermally insulating plastic, hard rubber, wood, or metal may be used.

It is therefore an object of the present invention to provide a new and improved object-carrying device that has all of the advantages of the prior art and none of the disadvantages.

It is therefore an object of the present invention to provide a plurality of finger-shaped depressions so that a user may place either of his hands within the depressions, thereby reducing the potential for the tray to slide on the user's hand while being carried.

Another object of the present invention is to provide a flat surface for placing items such as drinks and food upon so that the items may be transported to a desired location.

Yet another object of the present invention is to provide a means for reducing the risk that a serving tray will slide off a user's hand while the tray is in transit.

A further object of the present invention is to provide an easily balanced serving tray having resilient and durable construction.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
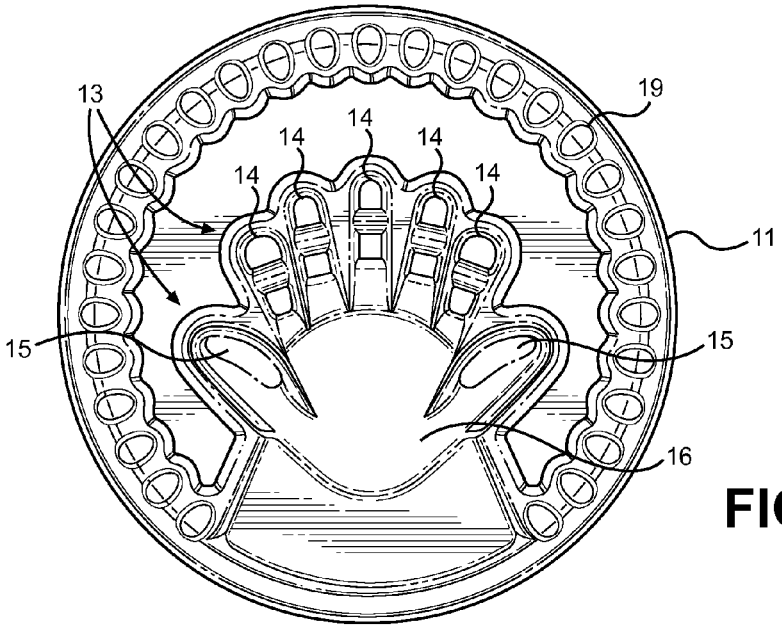
FIG. 1 shows a perspective view of the underside of the device. The plurality of finger shaped depressions indicate proper placement of the user's hand.

Reference is made herein to the attached drawings. Like reference numerals are used throughout the drawings to depict like or similar elements of the object-carrying device. For the purposes of presenting a brief and clear description of the present invention, the preferred embodiment will be discussed as used for transporting service items and other small, portable items. The figures are intended for representative purposes only and should not be considered to be limiting in any respect.

Referring now to FIG. 1, there is shown a perspective view of the lower surface 12 of the serving tray platform 11. A plurality of finger shaped depressions 13 is radially disposed along the lower surface. At least four inner finger depressions 14 are radially positioned according to a center axis of the tray. On either side of the inner finger depressions, at least one thumb depression 15 is disposed. A palm depression 16 is connected to the inner finger and thumb depressions, creating a hand shaped depression. Optionally, the palm depression may also include an area for a user's wrist. Together, the depressions look like a mold of a left and right hand with the inner fingers overlapping each other. In the embodiment shown, there are seven finger depressions, but more may be used to increase the possible positioning of a user's hand under the tray. For example, two additional inner finger depressions may be added, along with an additional thumb depression on either side. In smaller embodiments of the device, one of the inner finger depressions may be removed so that there are only four, reducing the total number f finger depressions to six. The outer edge of the lower surface may have a plurality of rim depressions 19, for resting fingers if the tray is being carried by an edge rather than from underneath.

Figure 2:
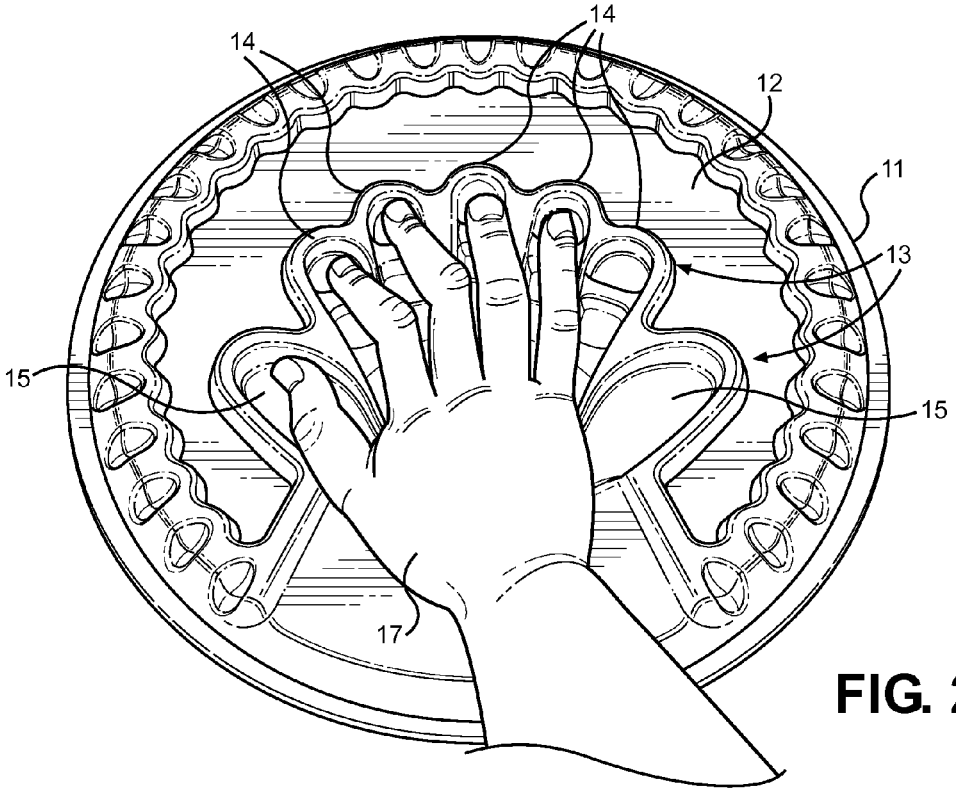
FIG. 2 shows a perspective view of a person's hand placed on the underside of the device, within the plurality of finger shaped depressions.
Figure 3:
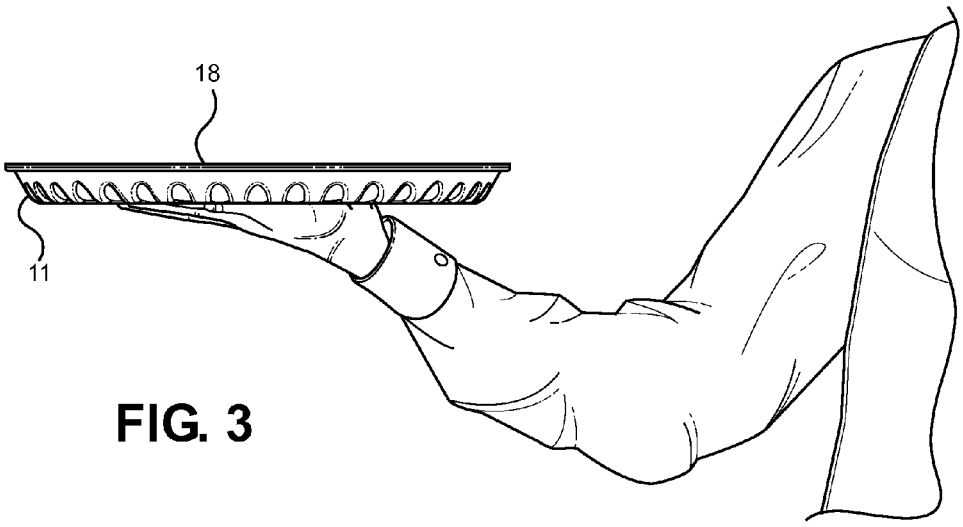
FIG. 3 shows an overhead side perspective view of the device in use. It is balanced on a user's hand with the top surface of the tray point upward.
Figure 4:
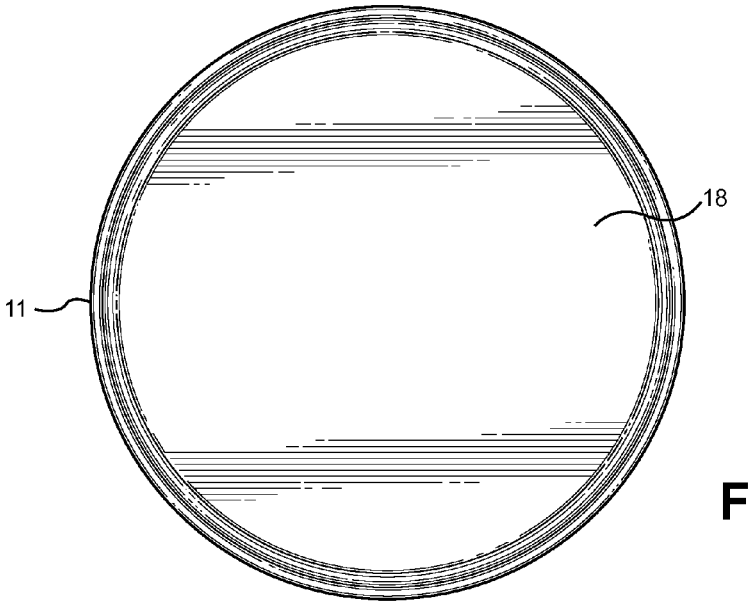
FIG. 4 shows an overhead view of an alternative embodiment of the invention with a concave upper surface for holding food items that are placed directly upon the tray. In this embodiment the tray is used as an easy-to-hold dinner plate.

Users can place either their right or left hand 17 within the depression regions in any desired configuration. Shown in FIG. 2, is a user's right hand aligned within the finger shaped depressions 13 on the lower surface 12 of the tray platform 11. The user's index, middle, ring, and pinky fingers are placed within the inner finger depressions 14 and the thumb is placed within the left thumb depression 15. A free inner finger depression is open to the left providing a user with additional room to maneuver his index finger into another position. Thus the molded depressions provide a customizable gripping experience and facilitates the comfortable placement of a user's fingers along the lower surface of the tray platform. The positioning is reversed if a person chooses to use their left and rather than their right Turning now to FIG. 3 there is shown a perspective view of the side and upper surface 18 of the serving tray platform 11. The platform is balanced on a user's hand 17 with the upper surface directed upwards. In a preferred embodiment the upper surface is smooth and flat to provide a stable surface for objects such as drink glasses and food dishes. In an alternative embodiment, shown in FIG. 4, the upper surface 18 is concave, with a small lip. This structure is ideal for placing food directly on the upper surface. The tray platform 11 is smaller in this embodiment so that the device may be used as a plate. It will be appreciated by partygoers and barbeque attendees, who are forced to stand with a plate of food balanced on one hand while they attempt to eat with the other. The present invention facilitates easy balancing of the plate because of the finger depressions on the lower surface. A variety of concave designs may be used for the construction of the dinner plate embodiment. Different sizes and shapes of concave region may be used. Additionally, a divider may be used to organize the upper surface into concave sections, for placement of multiple food items.

Figure 5:
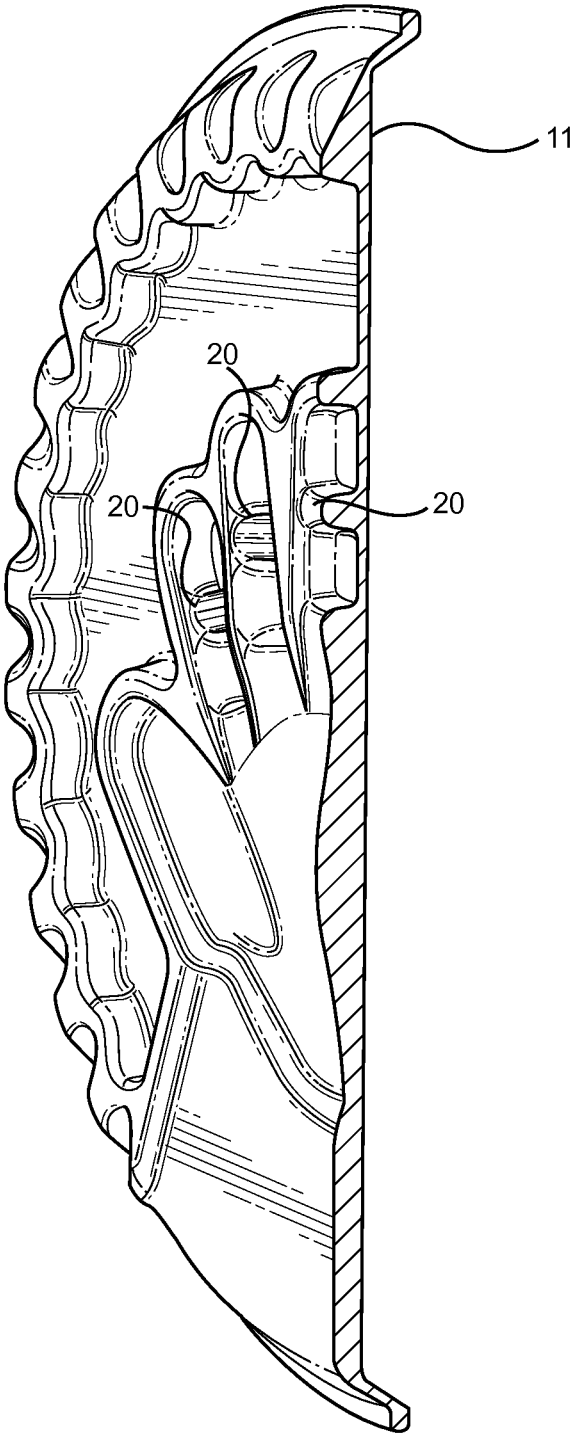
FIG. 5 shows a cross-sectional view of the present object carrying invention.

Referring now to FIG. 5, there is shown a cross-sectional view of the service tray device. The device is generally constructed of a hard material such as plastic, rubber, wood, or metal, though it is preferable that the device be constructed from a thermal insulator to protect a user's hand from extremes of heat or cold. In a primary embodiment the tray platform 11 is made from a single material throughout the device. Alternatively it made be constructed of a base material and then coated in a high-friction substance such as rubber or plastic. Coating the device in a high-friction material further reduces the likelihood that the tray will slide around on a user's hand while in use. The coating will make it easier for persons with wet or sweaty hands to carry the tray safely. Whether the tray is made of one material or coated in a high-friction material layer, the thickness and shape of the platform may vary according to the intended use of the tray.

In the primary embodiment the tray is similar in size to most wait staff trays, approximately 12-16 inches in diameter. The thickness of the tray platform may range from a few centimeters to a few inches This embodiment will be useful to waiters, waitresses and party hosts who wish to serve food and drink items to their guests. In an alternative embodiment the tray is smaller in diameter and may also have a reduced height. This embodiment provides a portable hot plate that can be placed under extremely hot or cold items. Food dishes served in hot bakeware or sizzling saucepans can be easily carried with the smaller hotplate tray. The hotplate embodiment should be constructed of a thermal insulator to protect the user's hands from extreme temperatures. In another alternative embodiment the diameter and width of the tray platform is reduced and the upper surface of the device is concave to form a portable plate. As discussed above the concavity may have a variety of shapes and organizations.

In use an individual places the device on its upper surface so that the lower surface is facing upwards. The user then places either his right or left hand within the depressions on the lower surface of the tray, aligning the index, middle, ring and pinky fingers with inner finger depressions. The users thumb is placed in the corresponding thumb depression and the palm rests in the palm depression. Next, the user flips the tray platform over so that the upper surface is directed upwards. While maintaining balance of the tray with the hand settled within the finger depression, the user places objects on the upper surface of the tray. The tray can then be carried to a destination and the objects placed on the upper surface removed for use.

The present invention thus provides an easy to use object-carrying device that reduces the chance that the tray will slide around on a user's hand. It comprises a tray platform with an upper and lower surface. Objects can be placed upon the upper surface for easy transport to a nearby location. Multiple items may be placed on the tray at the same time, thus negating the need for a user to carry items individually. In this manner, the tray reduces the amount of time needed to carry items. The lower surface of the tray features a set of molded depressions or cutouts of human hands. The hands, a right hand and left hand are oriented so that the thumbs face away from each other, the palms overlap and some of the inner fingers overlap. There may be ridges 20 in the thumb and finger depressions that correspond to indentations between the sections of a human finger. Alternatively each finger depressions may be smooth on the interior. There may be six or more depressions for fingers and thumbs, but in the preferred embodiment there will be seven, two thumbs and five fingers. The size and number of finger depressions will vary according to the embodiment of the device. Fingers placed within the depressions are less likely to slide around because they are somewhat restricted to the depressed spaces. The present invention does not require straps or any other securing means, making it easy for the tray platform to be transferred from one hand to the other. Servers, party hosts, and anyone else who need to balance awkward or fragile items during transit will appreciate the invention.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An object carrying tray comprising:

a tray platform having an upper and lower surface;

a plurality of depressions disposed along said lower surface of said tray platform, wherein said depressions comprise at least four finger depressions, at least two thumb depressions, and a palm depression;

said tray further comprising ridges in said thumb and finger depressions that correspond to the joints between the sections in a human finger.

2. The device of claim 1, wherein said plurality of depressions are disposed on said lower surface to form two overlapping hand depressions having thumb depressions that are directed in laterally opposing directions.

3. The device of claim 1, wherein said plurality of depressions includes five finger depressions, two thumb depressions, and a palm depression.

4. The device of claim 1, wherein said tray platform is constructed of a thermal insulator material.

5. The device of claim 1, wherein said tray platform is coated in a high-friction material.

6. The device of claim 1, wherein said upper surface is smooth and flat.

7. The device of claim 1, wherein said upper surface is concave.

8. The device of claim 7, wherein said upper surface has an outer rim.

9. The device of claim 1, wherein exterior depressions are disposed along an outer edge of said lower surface.

10. The device of claim 9, wherein said exterior depressions are adapted to receive a human finger.

* * * * *